US009734939B2

(12) United States Patent
Nakatani et al.

(10) Patent No.: US 9,734,939 B2
(45) Date of Patent: Aug. 15, 2017

(54) NOISE SUPPRESSION CABLE

(71) Applicant: Hitachi Metals, Ltd., Tokyo (JP)

(72) Inventors: Katsutoshi Nakatani, Hitachi (JP); Yosuke Sumi, Hitachinaka (JP); Kenji Ajima, Hitachiota (JP); Katsuya Akimoto, Hitachi (JP); Hiroshi Okikawa, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/167,684

(22) Filed: May 27, 2016

(65) Prior Publication Data

US 2016/0360654 A1 Dec. 8, 2016

(30) Foreign Application Priority Data

Jun. 2, 2015 (JP) ..... 2015-112485

(51) Int. Cl.
*H01B 11/10* (2006.01)

(52) U.S. Cl.
CPC ..... *H01B 11/1025* (2013.01)

(58) Field of Classification Search
USPC ..... 174/105 R
See application file for complete search history.

(56) References Cited

U.S. PATENT DOCUMENTS 6,984,788 B2 * 1/2006 Grogl ..... H01B 7/1895 174/106 R
2001/0017220 A1 * 8/2001 Nakahara ..... H01L 39/143 174/125.1
2004/0055772 A1 * 3/2004 Tsutsui ..... H01B 11/1025 174/36
2006/0137893 A1 * 6/2006 Sumi ..... H01R 24/562 174/84 R

FOREIGN PATENT DOCUMENTS

JP 2004-111317 A 4/2004

* cited by examiner

*Primary Examiner* — William H Mayo, III
*Assistant Examiner* — Krystal Robinson
(74) *Attorney, Agent, or Firm* — McGinn IP Law Group, PLLC

(57) ABSTRACT

A noise suppression cable includes an insulated wire including a conductor and an insulation covering an outer periphery of the conductor, a shield layer formed on an outer periphery of the insulated wire so as to be polygonal in a cross section thereof, an insulation layer formed on an outer periphery of the shield layer so as to be polygonal in a cross section thereof, and a magnetic tape layer formed on an outer periphery of the insulation layer so as to be polygonal in a cross section thereof.

20 Claims, 4 Drawing Sheets

12 CONDUCTOR
13 INSULATION

NOISE SUPPRESSION CABLE

The present application is based on Japanese patent application No. 2015-112485 filed on Jun. 2, 2015, the entire contents of which are incorporated herein by reference.

BACKGROUND OF THE INVENTION

1. Field of the Invention

The invention relates to a noise suppression cable using a magnetic material layer for suppressing electromagnetic noise.

2. Description of the Related Art

A noise suppression cable has been proposed in which a shield layer is provided on the outer side of a signal line and a magnetic material layer is provided on the outer side of the shield layer (see e.g. JP-A-2004-111317).

The noise suppression cable is constructed such that a tubular shield layer formed of a braided metal wire and having a circular cross section is provided on the outer side of a signal line and a tubular magnetic material layer having a circular cross section is formed on the outer side of the shield layer by spirally winding a magnetic tape.

SUMMARY OF THE INVENTION

If current flows at more than a certain level through the shield layer in the noise suppression cable, the magnetic material layer may reach magnetic saturation, causing a decrease in the noise suppression effect. To suppress the magnetic saturation of the magnetic material layer, the saturation magnetic flux density of the magnetic material layer may be increased, or the minimum magnetic path length (a magnetic path length on an inner surface of the magnetic material layer) may be increased by increasing a diameter of the magnetic material layer. However, according as the outer diameter of the cable is increased, the diameter of the magnetic material layer has to be increased.

It is an object of the invention to provide a noise suppression cable that allows a magnetic material layer to have a longer minimum magnetic path length while suppressing an increase in cable outer diameter.

(1) According to an embodiment of the invention, a noise suppression cable comprises:

an insulated wire comprising a conductor and an insulation covering an outer periphery of the conductor;

a shield layer formed on an outer periphery of the insulated wire so as to be polygonal in a cross section thereof;

an insulation layer formed on an outer periphery of the shield layer so as to be polygonal in a cross section thereof; and a magnetic tape layer formed on an outer periphery of the insulation layer so as to be polygonal in a cross section thereof.

In the above embodiment (1), a plurality of ones of the magnetic tape layer may be formed at a predetermined distance along a cable longitudinal direction.

Effects of the Invention

According to an embodiment of the invention, a noise suppression cable can be provided that allows a magnetic material layer to have a longer minimum magnetic path length while suppressing an increase in cable outer diameter.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
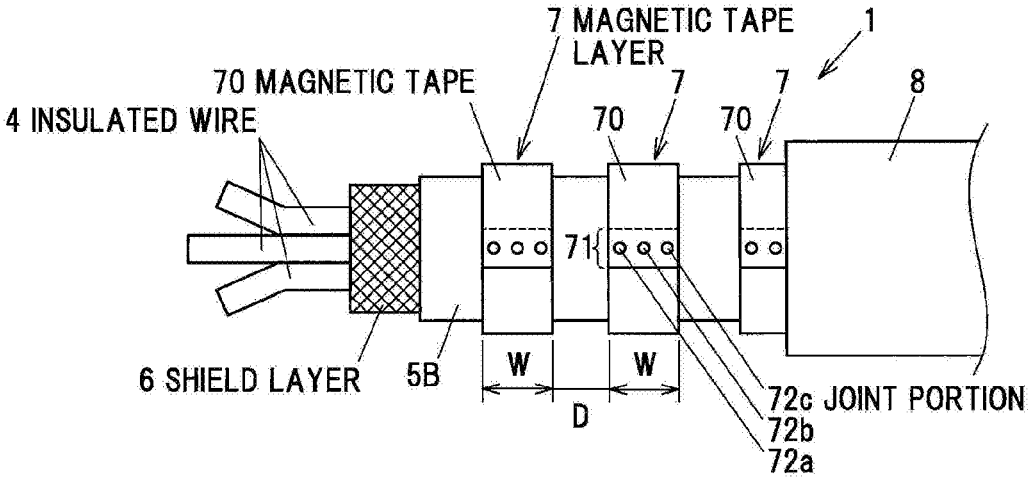
FIG. 1 is a front view schematically showing a noise suppression cable in an embodiment of the present invention.

An embodiment of the invention will be described below in reference to the drawings. Constituent elements having substantially the same functions are denoted by the same reference numerals in each drawing and the overlapping explanation thereof will be omitted.

Embodiment

Figure 2:
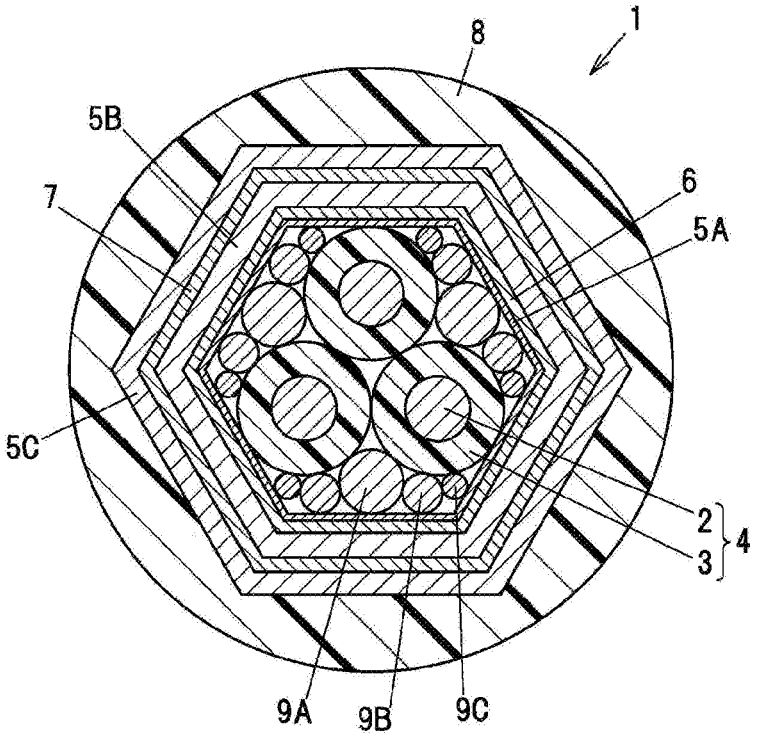
FIG. 2 is a cross sectional view showing the noise suppression cable shown in FIG. 1.

FIG. 1 is a schematic front view showing a configuration of a noise suppression cable in an embodiment of the invention. FIG. 2 is a cross sectional view showing the noise suppression cable shown in FIG. 1.

A noise suppression cable 1 is provided with plural insulated wires 4 (three in the present embodiment) each formed by covering an outer periphery of a conductor 2 with an insulation 3, a resin tape layer 5A formed by winding a resin tape around the plural insulated wires 4 with fillers 9A to 9C interposed therebetween, a shield layer 6 provided around the resin tape layer 5A, a resin tape layer 5B provided around the shield layer 6, plural magnetic tape layers 7 having a predetermined width W and formed around the resin tape layer 5B at a predetermined distance D along a cable longitudinal direction, a resin tape layer 5C provided around the plural magnetic tape layers 7 and the resin tape layer 5B, and a sheath 8 as an insulating protective layer formed of a resin, etc.

The fillers 9A to 9C having different diameters are arranged around the plural insulated wires 4 so that the resin tape layer 5A, the shield layer 6, the resin tape layer 5B, the magnetic tape layer 7 and the resin tape layer 5C have a hexagonal cross-sectional shape. Thus, the minimum magnetic path length of the magnetic tape layer 7 (a magnetic path length on an inner surface of the magnetic tape layer 7) is longer than cables having the same outer diameter and provided with a tubular magnetic tape layer having a circular cross-sectional shape. The magnetic tape layer 7 having a hexagonal cross-sectional shape is an example of the magnetic material layer having a polygonal cross-sectional shape.

The insulated wire 4 transmits power or a signal at a frequency of, e.g., DC to not more than 1 MHz. Although plural insulated wires 4 are provided in the present embodiment, the number of the insulated wires 4 may be one. The insulated wire 4 may alternatively be a twisted pair wire which transmits differential signals.

The resin tape layer 5A is formed by spirally winding a resin tape around the plural insulated wires 4 with the fillers 9 interposed therebetween throughout the cable longitudinal direction. The resin tape layer 5B is formed by spirally winding a resin tape around the shield layer 6 throughout the cable longitudinal direction. The resin tape layer 5C is formed by spirally winding a resin tape around the resin tape layer 5B and the magnetic tape layers 7 throughout the cable longitudinal direction. Tapes made of, e.g., a resin such as polyethylene terephthalate (PET) or polypropylene-based resin can be used as the resin tapes constituting the resin tape layers 5A to 5C.

The shield layer 6 is formed by, e.g., braiding conductive wires and is connected to a ground. Alternatively, the shield layer 6 may be formed by winding a tape with a conductor attached thereto.

(Configuration of Magnetic Tape Layer 7)

To form the magnetic tape layer 7, a magnetic tape 70 having the width W is wrapped around the resin tape layer 5B so as to overlap at both edges and an overlapping portion 71 is resistance-welded at joint portions 72*a* to 72*c*. The width W of the magnetic tape 70 is preferably, e.g., 5 to 50 mm. The distance D between the magnetic tape layers 7 is preferably, e.g., 5 to 50 mm.

The magnetic material constituting the magnetic tape 70 is preferably a soft magnetic material having low magnetic coercivity and high magnetic permeability to reduce electromagnetic noise. The soft magnetic material used can be, e.g., an amorphous alloy such as Co-based amorphous alloy or Fe-based amorphous alloy, a ferrite such as Mn—Zn ferrite, Ni—Zn ferrite or Ni—Zn—Cu ferrite, or a soft magnetic metal such as Fe—Ni alloy (permalloy), Fe—Si—Al alloy (sendust) or Fe—Si alloy (silicon steel), etc.

Functions and Effects of the Embodiment

The following functions and effects are obtained in the present embodiment.

(1) When electromagnetic noise is emitted from the insulated wires 4, common-mode noise current flows through the shield layer 6. The common-mode noise current is reduced by the magnetic tape layer 7. Thus, emission of electromagnetic noise to the outside of the noise suppression cable 1 is prevented.

(2) By forming the magnetic tape layer 7 so as to have a hexagonal cross-sectional shape, it is possible to increase the minimum magnetic path length of the magnetic tape layer 7 without increasing the cable outer diameter.

(3) Since the magnetic tape layers 7 having a predetermined width are provided at a predetermined distance in the cable longitudinal direction, it is possible to obtain the an electromagnetic noise suppression effect equivalent to that of a cable having a magnetic tape layer throughout the cable longitudinal direction, and excellent flexibility is also obtained.

(4) Since a ferrite core is not used, an appearance is excellent, problems during handling such as cracks on the ferrite core do not arise, and it is possible to suppress electromagnetic noise emission without increasing the outer diameter of the cable.

Example 1

Figure 3B:
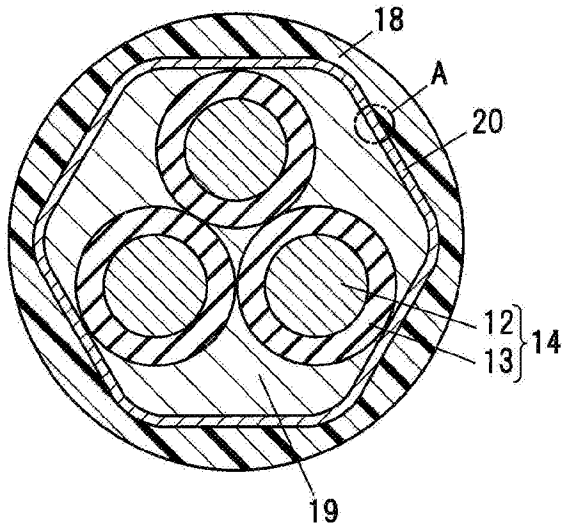
FIG. 3B is an illustration diagram showing an analytical model in Example.
Figure 3A:
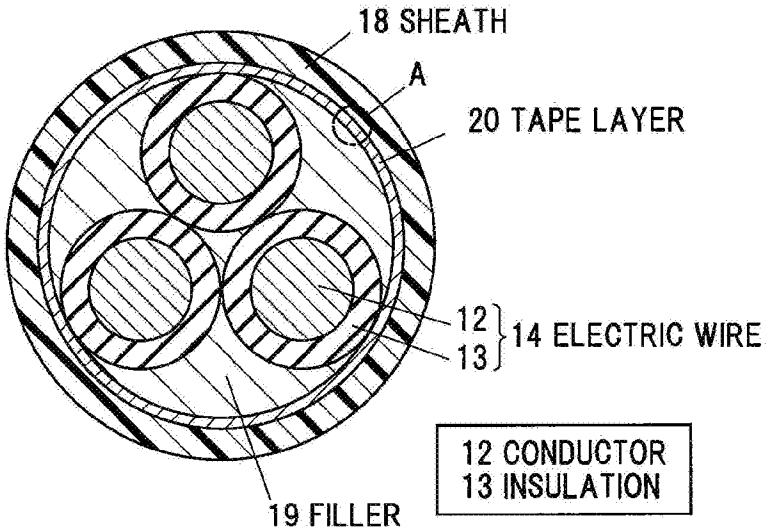
FIG. 3A is an illustration diagram showing an analytical model in Comparative Example.
Figure 3C:
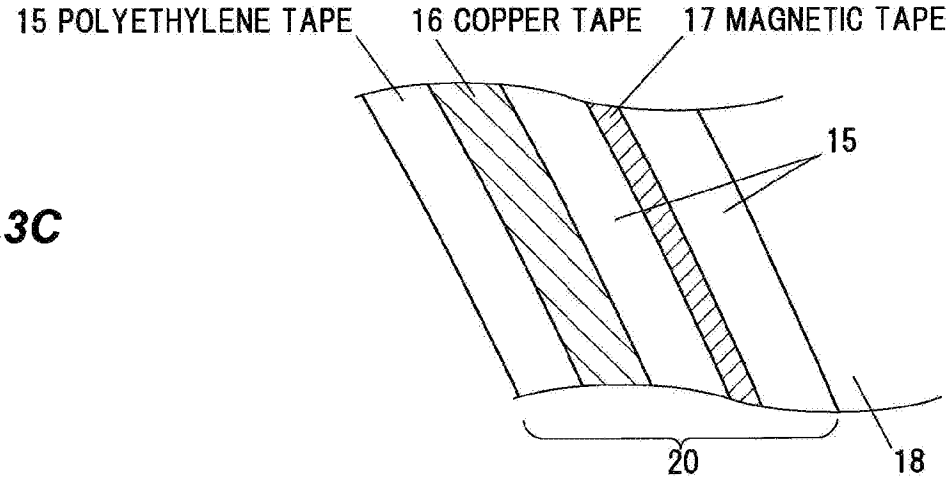
FIG. 3C is an enlarged view showing a portion A in FIGS. 3A and 3B.

FIG. 3A is an illustration diagram showing an analytical model in Comparative Example, FIG. 3B is an illustration diagram showing an analytical model in Example and FIG. 3C is an enlarged view showing a portion A in FIGS. 3A and 3B.

The analytical model in Comparative Example is a three-core noise suppression cable in which a circular tape layer 20 is provided around three electric wires 14, each formed by covering a conductor 12 with an insulation 13, with a filler 19 interposed therebetween, and a sheath 18 is provided around the tape layer 20, as shown in FIG. 3A.

The analytical model in Example is a three-core noise suppression cable in which a tape layer 20 having a hexagonal shape in the same manner as the embodiment is provided around the three same electric wires 14 as Comparative Example with the filler 19 interposed therebetween, and the sheath 18 is provided around the tape layer 20, as shown in FIG. 3B.

The tape layer 20 is the same in Comparative Example and in Example and has a structure in which polyethylene tapes 15 are arranged on both sides of a copper tape 16 corresponding to the shield layer and also on both sides of a magnetic tape 17 corresponding to the magnetic layer, as shown in FIG. 3C.

Theoretical Calculation

When a length of one turn of a magnetic tape wound around the shield layer of the cable is defined as the minimum magnetic path length $l_{min}$, a magnetic flux density B of the magnetic tape is defined from:

$$B=\mu H \tag{1}$$

$$H=\mu I/l_{min} \tag{2}$$

and is expressed as:

$$B=\mu I/l_{min} \tag{3}$$

Since a saturation magnetic flux density Bs of Co-based amorphous is Bs=0.6, a current Is at which the magnetic tape reaches magnetic saturation is:

$$Is=Bs\ l_{min}/\mu N \tag{4}$$

based on the formula (3). Here, B is magnetic flux density [T], Bs is saturation magnetic flux density [T], H is magnetic field [A/m], μ is permeability ($\mu=\mu_s\mu_0$), $\mu_0$ is vacuum permeability ($\mu_0=4\pi\times10^{-7}$), μs is relative permeability, $l_{min}$ is minimum magnetic path length [m], I is current [A], Is is current [A] at which the magnetic tape reaches magnetic saturation, and N is the number of turns of the magnetic tape (=1).

It is understood from the formula (4) that the current Is at which the magnetic tape reaches magnetic saturation depends on the minimum magnetic path length, relative permeability and saturation magnetic flux density of the magnetic tape. Therefore, in theory, the current Is at which the magnetic tape reaches magnetic saturation can be increased by increasing the minimum magnetic path length of the magnetic tape.

Analysis Conditions

Using an analysis software, a current value at which the magnetic tape reaches magnetic saturation was measured in Example and Comparative Example. The analysis conditions were as follows: JMAG Designer ver. 14 used as an analysis software, the frequency range of interest from 1 kHz to 1 MHz, the applied current value of 1 to 100 A, and the mesh size of 0.03 mm. The magnetic tape 17 had a relative permeability of 3500 under DC and a resistivity of $1.42\times10^{-6}$ μm, and the eddy current value was taken into account. The dimensions of the analytical models in FIGS. 3A and 3B are shown in Table 1.

TABLE 1

| | Diameter of conductor [mm] | Thickness of insulation [mm] | Thickness of copper tape [mm] | Thickness of polyethylene tape [mm] | Minimum thickness of sheath [mm] | Outer diameter of cable [mm] | Minimum magnetic path length [mm] | Saturation magnetic flux density [t] of magnetic tape |
|---|---|---|---|---|---|---|---|---|
| Comparative Example | 9.1 | 2 | 0.1 | 0.1 | 1.6 | 35.0 | 95.5 | 0.6 |
| Example | 9.1 | 2 | 0.1 | 0.1 | 1.6 | 39.2 | 103.4 | 0.6 |

Figure 4A:
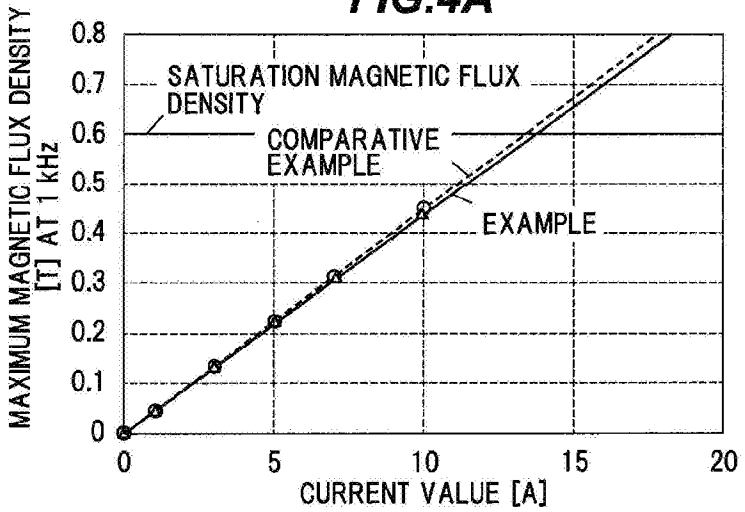
FIG. 4A is a graph showing the maximum magnetic flux density [T] at 1 kHz.
Figure 4B:
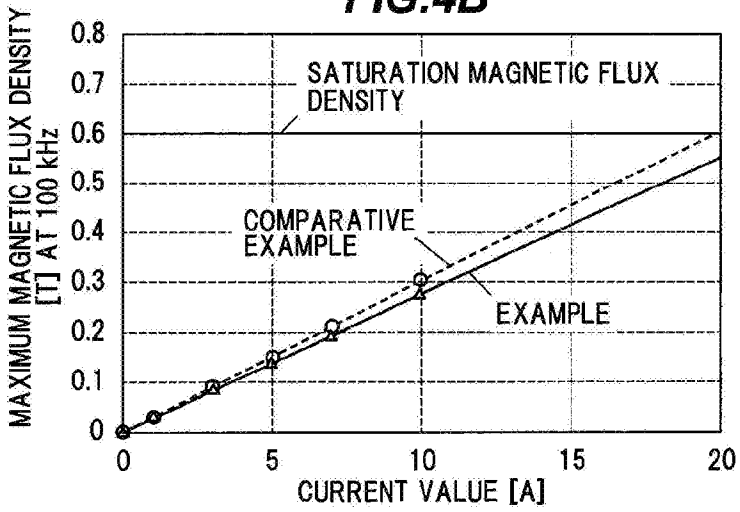
FIG. 4B is a graph showing the maximum magnetic flux density [T] at 100 kHz.
Figure 4C:
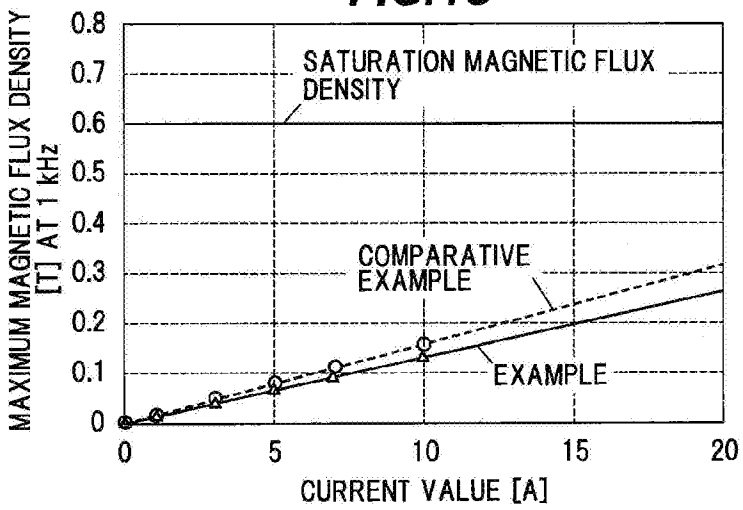
FIG. 4C is a graph showing the maximum magnetic flux density [T] at 1 MHz.

FIG. 4A is a graph showing the maximum magnetic flux density [T] at 1 kHz, FIG. 4B is a graph showing the maximum magnetic flux density [T] at 100 kHz and FIG. 4C is a graph showing the maximum magnetic flux density [T] at 1 MHz. Table 2 shows current values at which the magnetic tape 17 reaches saturation.

TABLE 2

| | Current value [A] at which magnetic tape reaches saturation | | |
|---|---|---|---|
| | 1 kHz | 100 kHz | 1 MHz |
| Comparative Example | 13.40 | 19.80 | 38.22 |
| Example | 13.75 | 21.74 | 45.80 |

Evaluation

As shown in Table 2, the increase in the minimum magnetic path length in Example results in that the current value at which the magnetic tape reaches saturation is larger in Example than in Comparative Example.

The embodiment of the invention is not limited to that described above and various embodiments can be implemented. For example, although plural magnetic tape layers 7 are provided in the present embodiment, the number of the magnetic tape layers 7 may be one. The one magnetic tape layer 7 may have a width of 5 to 50 mm and may be continuously formed throughout the cable longitudinal direction. In addition, the magnetic tape layer 7 is formed to have a hexagonal cross-sectional shape in the present embodiment, but may be formed in a polygon with not less than 5 and not more than 24 sides. In addition, the magnetic material layer may be formed of a magnetic material having a polygonal cross-sectional shape or may be formed of a magnetic powder-containing resin having a polygonal cross-sectional shape.

In addition, some of the constituent elements in the embodiment can be omitted or changed without changing the gist of the invention. For example, the resin tape layer 5C formed on the outer side of the magnetic tape layers 7 can be omitted.

What is claimed is:

1. A noise suppression cable, comprising:

an insulated wire comprising a conductor and an insulation covering an outer periphery of the conductor;

a first resin tape layer formed around an outer periphery of the insulated wire so as to be polygonal in a cross-section thereof;

a shield layer formed on an outer periphery of the first resin tape layer so as to be polygonal in a cross-section thereof;

a second resin tape layer formed on an outer periphery of the shield layer so as to be polygonal in a cross-section thereof;

a magnetic tape layer formed on an outer periphery of the second resin tape layer so as to be polygonal in a cross-section thereof; and a third resin tape layer formed on an outer periphery of the magnetic tape layer so as to be polygonal in a cross-section thereof.

2. The noise suppression cable according to claim 1, wherein a plurality of ones of the magnetic tape layer are formed at a predetermined distance along a cable longitudinal direction.

3. The noise suppression cable according to claim 1, wherein the polygonal shape comprises a polygon with not less than 5 and not more than 24 sides.

4. The noise suppression cable according to claim 1, wherein the insulated wire comprises plural insulated wires and wherein fillers are interposed around the plural insulated wires.

5. The noise suppression cable according to claim 1, further comprising a sheath formed on an outer periphery of the third resin tape layer.

6. The noise suppression cable according to claim 4, wherein the fillers have different diameters.

7. The noise suppression cable according to claim 1, wherein the magnetic tape layer is wrapped around the second resin tape layer so as to overlap at both edges thereof, and wherein an overlapping portion of the magnetic tape layer includes joint portions.

8. The noise suppression cable according to claim 1, wherein at least one of the first, second and third resin tape layers comprises polyethylene terephthalate (PET), a polyethylene tape or a polypropylene-based resin.

9. The noise suppression cable according to claim 1, wherein at least one of the first, second and third resin tape layers includes a spirally wound resin tape throughout a cable longitudinal direction.

10. The noise suppression cable according to claim 1, wherein a plurality of ones of the magnetic tape layer are provided, have a predetermined width and are formed around the second resin tape layer at a predetermined distance along a cable longitudinal direction.

11. The noise suppression cable according to claim 1, wherein the shield layer includes braided conductive wires throughout a cable longitudinal direction.

12. The noise suppression cable according to claim 1, wherein a width of the magnetic tape layer is 5 mm to 50 mm.

13. The noise suppression cable according to claim 2, wherein the insulated wire comprises plural insulated wires and wherein fillers are interposed around the plural insulated wires.

14. A noise suppression cable, comprising:

an insulated wire comprising a conductor and an insulation covering an outer periphery of the conductor;

a first resin tape layer formed around an outer periphery of the insulated wire so as to be polygonal in a cross-section thereof;

a shield layer formed on an outer periphery of the first resin tape layer so as to be polygonal in a cross-section thereof;

a second resin tape layer formed on an outer periphery of the shield layer so as to be polygonal in a cross-section thereof;

a magnetic tape layer formed on an outer periphery of the second resin tape layer so as to be polygonal in a cross-section thereof;

a third resin tape layer formed on an outer periphery of the magnetic tape layer so as to be polygonal in a cross-section thereof;

wherein the insulated wire comprises plural insulated wires and wherein fillers are interposed around the plural insulated wires; and the plural amount of fillers being interposed between the plural insulated wires and the first resin tape layer.

15. The noise suppression cable according to claim 14, wherein the shield layer includes braided conductive wires throughout a cable longitudinal direction.

16. The noise suppression cable according to claim 14, wherein a plurality of ones of the magnetic tape layer are provided and wherein a distance between the magnetic tape layers is 5 mm to 50 mm.

17. The noise suppression cable according to claim 14, wherein the polygonal shape comprises a polygon with not less than 5 and not more than 24 sides.

18. The noise suppression cable according to claim 14, further comprising a sheath formed on an outer periphery of the third resin tape layer of the magnetic tape layer.

19. The noise suppression cable according to claim 14, wherein the fillers have different diameters.

20. The noise suppression cable according to claim 14, wherein the magnetic tape layer is wrapped around the second resin tape layer so as to overlap at both edges thereof, and wherein an overlapping portion includes joint portions.

* * * * *